US009386839B2

(12) United States Patent
Bonnin et al.

(10) Patent No.: US 9,386,839 B2
(45) Date of Patent: Jul. 12, 2016

(54) COLD EFFECT APPLICATOR TIP

(71) Applicant: ALBEA SERVICES, Gennevilliers (FR)

(72) Inventors: Thomas Bonnin, Pronleroy (FR); Aurélie Emond, Suresne (FR)

(73) Assignee: ALBEA SERVICES, Gennevilliers (FR)

( * ) Notice: Subject to any disclaimer, the term of this patent is extended or adjusted under 35 U.S.C. 154(b) by 327 days.

(21) Appl. No.: 13/946,955

(22) Filed: Jul. 19, 2013

(65) Prior Publication Data

US 2014/0023425 A1 Jan. 23, 2014

(30) Foreign Application Priority Data

Jul. 20, 2012 (FR) ..... 12 57054

(51) Int. Cl.

| | |
|---|---|
| ***A45D 34/04*** | (2006.01) |
| ***B43K 1/06*** | (2006.01) |
| ***A46B 11/00*** | (2006.01) |
| ***A45D 40/26*** | (2006.01) |

(52) U.S. Cl.

CPC ..... *A45D 40/26* (2013.01); *A45D 34/04* (2013.01); *A45D 2200/15* (2013.01)

(58) Field of Classification Search

CPC ... A45D 40/26; A45D 34/04; A45D 2200/15; A46B 11/00

USPC ..... 401/265, 186, 128, 1, 123; 132/320

See application file for complete search history.

(56) References Cited

U.S. PATENT DOCUMENTS

| | | | | |
|---|---|---|---|---|
| 7,883,287 | B2 * | 2/2011 | Thorpe | A45D 34/04 401/265 |
| 7,959,369 | B2 * | 6/2011 | Gueret | A45D 34/00 401/1 |
| 8,573,874 | B2 * | 11/2013 | Neuner | A45D 34/04 401/261 |
| 2002/0021932 | A1 * | 2/2002 | Gueret | A45D 34/041 401/191 |
| 2003/0100936 | A1 | 5/2003 | Altshuler et al. | |
| 2007/0186951 | A1 * | 8/2007 | Gueret | A45D 34/00 132/320 |
| 2007/0206986 | A1 * | 9/2007 | Gueret | A45D 34/04 401/123 |
| 2008/0160307 | A1 * | 7/2008 | Bauchet | C08K 11/00 428/402 |
| 2008/0279616 | A1 * | 11/2008 | Thorpe | A45D 34/04 401/265 |
| 2009/0012213 | A1 * | 1/2009 | Schmaucks | C08L 67/02 524/13 |
| 2015/0023721 | A1 * | 1/2015 | Gieux | A45D 34/04 401/265 |

FOREIGN PATENT DOCUMENTS

| | | | | |
|---|---|---|---|---|
| JP | EP 1070738 | A1 * | 1/2001 | C08K 3/04 |

OTHER PUBLICATIONS

Fei, et al., "Thermal Conduction of Thermoplastics Polyimide Composites Modified with Graphite/Carbon Fiber," Database Compendex, Engineering Info Inc., NY, NY, Oct. 2007.

* cited by examiner

*Primary Examiner* — Mark A Laurenzi
*Assistant Examiner* — Thomas M Abebe
(74) *Attorney, Agent, or Firm* — Steven M. Greenberg, Esq.; CRGO Law

(57) ABSTRACT

A cold effect applicator tip for cosmetic products is disclosed. The applicator tip is made of a plastic material comprising organic fillers, metallic fillers or a mixture of organic fillers and metallic fillers. A container for cosmetic products with a cold effect applicator tip is also provided, comprising a reservoir to contain a cosmetic product and an applicator tip such as above described.

12 Claims, 1 Drawing Sheet

COLD EFFECT APPLICATOR TIP

CROSS REFERENCE TO RELATED APPLICATIONS

This application claims priority under 35 U.S.C. §119(a) to French Patent Application Serial Number 1257054, filed Jul. 20, 2012, entitled "COLD EFFECT APPLICATOR TIP", the entirety of which is incorporated herein by reference.

BACKGROUND OF THE INVENTION

1. Field of the Invention

The invention relates to the field of applicator tips for cosmetic products and more particularly the field of cold effect applicator tips for cosmetic products.

2. Description of Related Art

There are applicator tips allowing a cold effect to be conferred to the user when the latter put the applicator tip in contact with his skin.

For example, the document US 2003/0100936 describes an applicator tip allowing a cold effect to be conferred to the user. Such applicator tip comprises a hollow roller adapted to be put in contact with the user's skin. Such hollow roller may be made of a metal, a ceramics, a plastics, a quartz sapphire. Said hollow roller also includes a reservoir filled with a freezable liquid. Before use, such roller should be arranged in a sufficiently cold place so as to allow the liquid to be frozen, for example in a freezer. Upon its use, the frozen liquid forms a heat well, the roller wall then creating an interface between the skin and the frozen liquid. The frozen liquid cools the skin through the roller wall.

Thus, with such applicator, the use of a freezing means is necessary. Consequently, the use of such applicator tip is power consuming.

Furthermore, there are applicator tips that do not need, previously to the use, a cooling through a cooling means such as for example a freezer.

An example of applicator tip of this type is disclosed in the document U.S. Pat. No. 7,883,287. Such applicator tip includes a thermal storing body in ceramics or in metal to apply the cosmetic product contained in a reservoir. The storing body presents a volume comprised between 300 and 700 $mm^3$ and the mass thereof can be comprised between 0.3 and 0.7 g. The surface of the applicator tip is polished. The cold effect of the applicator tip is obtained by the simple contact between the thermal storing body and the user's skin.

However, the use of a metal is not recommended, in particular because the metal must come in contact with the cosmetic product being applied. Indeed, the metal can lead to an oxidation of the cosmetic product, thereby damaging its properties.

Furthermore, the ceramics is a quite expansive material. For example, a ceramics being usually used to confer a cold effect is based on alumina at 96% in weight. The ceramic working is relatively complex. In fact, it needs the following steps of:

- mixing ceramic powder with a thermoplastic polymer binder until obtaining a homogenous mixture;
- heating the homogenous mixture;
- extruding the homogenous mixture under the shape of granules;
- heating the granules to melt the binder;
- injecting the homogenous mixture made of ceramic powder and melted binder in a mould to obtain a raw part;
- heating the raw part at about 400° C. to remove the binder so as to obtain a baked part;

- heating the baked part at 85% of the melting temperature of the ceramics for sintering, allowing for the densification and the reduction of the ceramic powder into a dense solid with elimination of the pores.

Also, such ceramics further needs an assembling step with the use of a hoop so as to enclose the ceramic against the container in which the cosmetic product is contained.

BRIEF SUMMARY OF THE INVENTION

An objective of the present application is to obviate at least one of the disadvantages of the prior art.

In particular, an object of the present application is to provide a cold effect applicator tip, the use of which is electrically economical and its manufacture cheap, while limiting the oxidation risk of the cosmetic product to be applied.

To do so, the invention relates to a cold effect applicator tip for cosmetic products characterized in that the applicator tip is made of a plastic material comprising organic fillers, metallic fillers or a mixture of both.

Thus, in consequence of the applicator tip, it is possible to confer a cold effect while avoiding the use of a massive metal applicator being able to oxide the cosmetic product and reducing the manufacturing cost of the applicator tip with respect to the ceramic applicator tips. It is also possible thanks to the use of a filled plastic material to obtain applicator tips with various forms related to the assembling functions.

Indeed, the number of assembling possibilities to a reservoir, such as a tube, is higher for the applicator tips in a filled plastic material than the one relative to a ceramic applicator tip. In fact, since the manufacture of the applicator tip in a metallic and/or organic filled plastic material constitutes a standard injection process, it is possible to envisage different solutions for the assembling on a reservoir such as a tube. For example, it is possible to carry out the injection of the applicator tip directly on the tube skirt. It is also possible to overmould the applicator tip on a polyolefin insert, thereby allowing a standard clipping on a tube head. As another example, it is possible to carry out an injection of the applicator tip with an internal thread, the applicator being then screwed on the tube head. As a further example, it is possible to carry out an injection of the applicator tip with shapes allowing a clipping of it in the tube head.

A container for products with a cold effect applicator tip is also provided, comprising a reservoir to contain a cosmetic product and an applicator tip such as above described.

BRIEF DESCRIPTION OF THE SEVERAL VIEWS OF THE DRAWINGS

Other objectives, characteristics and advantages will appear on reading the following detailed description, referring to the drawing given as being illustrative and non limitative, amongst which.

DETAILED DESCRIPTION OF THE INVENTION

Figure 1:
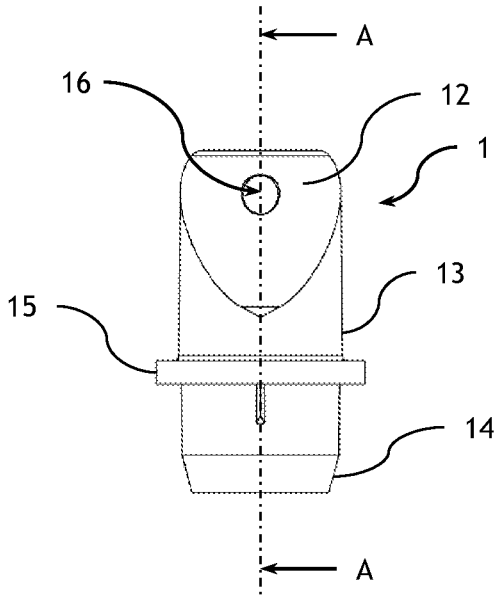
FIG. 1 is a front view of a cold effect applicator tip.
Figure 2:
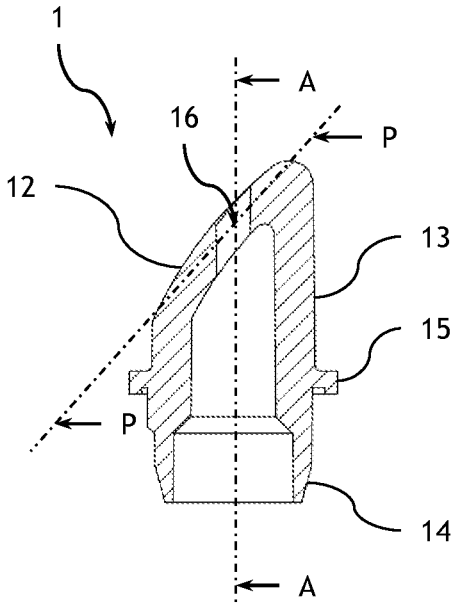
FIG. 2 is a longitudinal section of the applicator tip of FIG. 1.

Referring to FIGS. 1 and 2, a cold effect applicator tip for cosmetic products is described herein below.

Such applicator tip is made of a plastic material comprising organic fillers, metallic fillers or a mixture of both, so called organic or metallic filled plastic material.

The expression "filled plastic material" means in the present application a plastic base forming a plastic continuous solid phase, in which filler particles have been dispersed. The plastic base can be a polyetheretherketone (PEEK), a phenylene polysulfide (PPS), a polyphtalamide (PPA) or a polyamide (PA). The plastic base can also be a polyimide (PI), a polyoxymethylene (POM), a polyimide-amide (PAI), a copolyester, a polypropylene or an elastomer.

The above mentioned materials being able to form the plastic base are current materials and are less expensive than ceramics. Furthermore, the use of a plastic base allows for the simple manufacture of the applicator tip for example by injection. Moreover, it is possible to confer to the applicator tip various shapes related to the assembling functions that cannot be obtained with a ceramic material.

The fillers included in the plastic base are dispersed metallic and/or organic solid particles. If the plastic material is filled with metallic fillers, it can comprise solid particles in metal element or in metal salt. The solid particles in metal element are for example in aluminum, bronze, chromium, copper and the alloys thereof. The solid particles in metal salt are for example alkaline-earth salts of magnesium, beryllium, calcium, strontium, barium, radium and metallic salts of iron, aluminum, copper, chromium. If the plastic material is filled with organic fillers, it can comprise organic solid particles of graphite, carbon fiber or a mixture of both. If the plastic material is filled with both metallic and organic fillers, it comprises both types of the above mentioned solid particles.

Preferably, the metallic and/or organic fillers represent at least about 20 wt % of the plastic material, more preferably at least about 30 wt %, most preferably at least about 40 wt %, mainly preferably lower than about 70 wt %.

Examples of a metallic filled plastic material are a polyamide, in particular filled with about 45 wt % of mineral salts, a polyphathamide filled with about 40 wt % of carbon, graphite and alumina powder, a phenylene polysulfide filled with about 40 wt % of mineral salts of magnesium and iron and still a polyetheretherketone filled with about 40 wt % of graphite and carbon fibers, and even a filled copolyester or also filled polypropylene.

For example, the polyamide could be filled between about 10% and about 30% with graphite, between about 1% and about 5% of titanium dioxide and/or between about 0.1% and 1% of silica quartz.

All those above mentioned materials allow a cold effect to be obtained. The cold effect can be described as a trouble of the equilibrium state in which the skin of the applicator tip user is before contacting the applicator tip with the skin.

Indeed, the skin has the capacity upon contact with the air at a given temperature to maintain a temperature close to its initial temperature, i.e. about 35° C.

A cold effect applicator tip, when it is put in contact with the skin, breaks such equilibrium, thereby providing the cold effect. The cold effect disappears as the applicator tip is heated upon the contact with the skin.

The slowness with which the applicator tip is heated until reaching a new thermal stability is called thermal inertia.

The thermal inertia of the applicator tip can be quantified by:

- the thermal diffusivity characterizing the capacity of the applicator tip material to move calories through its mass;
- the thickness of the constituent material of the applicator tip; and
- the thermal effusivity of the constituent material of the applicator tip characterizing the rapidity of the material to absorb calories from the outside.

The thermal diffusivity and the material thickness determine the time taken by such material to reach a new thermal stability.

The diffusivity D and the effusivity E are related to the three following characteristics:

- the thermal conductivity λ which quantifies the behavior of the material to conduct heat and is intimately related to the electrical conductivity since, on the atomic point of view, it is a function of the movement of the charge carriers (electrons) and of the oscillation of the atoms on themselves;
- the volume mass ρ; and
- the mass thermal capacity c which expresses the quantity of thermal power necessary to increase the temperature of a body by one degree;

by the following formulas:

$$E = \sqrt{\lambda \rho c} \text{ and } D = \frac{\lambda}{\rho c}$$

From the thermal effusivity $E_{material}$ of the material forming the applicator tip and the thermal effusivity $E_{skin}$ of the skin, it is possible to determine the contact temperature $T_{contact}$ according to the following formula:

$$T_{contact} = \frac{E_{material} \times T_{material} + E_{skin} \times T_{skin}}{E_{material} + E_{skin}}$$

The plastic formula preferably presents an effusivity being higher than or equal to about 4000 $J.K^{-1}.m^{-2}.sec^{-1/2}$, more preferably higher than or equal to about 4700 $J.K^{-1}.m^{-2}.sec^{-1/2}$, most preferably higher than or equal to about 7100 $J.K^{-1}.m^{-2}.sec^{-1/2}$, particularly preferably higher than or equal to about 7300 $J.K^{-1}.m^{-2}.sec^{-1/2}$.

Simultaneously, the plastic material preferably presents a diffusivity being higher than about 6 $m^2$/sec, more preferably higher than or equal to about 7.8 $m^2$/sec, most preferably higher than or equal to about 12 $m^2$/sec.

A large effusivity combined with a large diffusivity allows the heat to be rapidly evacuated from the skin, through the plastic material of the applicator tip to the colder ambient air.

The plastic material preferably presents a volume mass being higher than about 1.4 g/$cm^3$, more preferably higher than or equal to about 1.6 g/$cm^3$, most preferably lower than or equal to about 2 g/$cm^3$.

The plastic material preferably presents a thermal conductivity being higher than or equal to about 10 W/(m.K). Methods for measuring the thermal conductivity are known, an example of which is given in the ISO/CD22007 standard.

The plastic material preferably provides a cold effect during at least about 10 sec, more preferably during more than about 15 sec, most preferably between about 15 sec and about 20 sec.

The applicator tip can also present a lacquered application surface with or without any tint, metalized or galvanized.

A lacquered or metalized application surface allows the esthetical aspect of the applicator tip to be improved. Indeed, the fillers added to the plastic base are generally with dark colors, for example black. Lacquering and metalizing the application surface do not affect in any way the properties of the subjacent metallic or organic filled plastic material.

Lacquering can be carried out by the application of a standard lacquer as usually used.

The metal used for metalizing the application surface may be a pure metal or an alloy. Amongst metals, aluminum, silver, nickel, chromium, copper, titanium and gold will be mentioned. Amongst alloys, stainless steel and aluminum/ copper alloys can be mentioned. The metal coating formed upon metallization on the application surface is then lacquered to protect it. Galvanization can be made from a target in aluminum, copper, chromium, nickel, silver or gold.

Those applicator tips, the application surface of which is metalized or galvanized do not present the same disadvantages as the applicator tips being entirely made in metal. Indeed, unlike the latter, the cosmetic product is only in contact with the metal at the application time. Furthermore, the application surface can be cleaned. Thus, there is no risk of oxidation of the cosmetic product to be applied.

The applicator tip 1 comprises an external application surface 12 and which is adapted to be put in contact with the skin. Such application surface 12 can extend according to an inclined plane P with respect to the axis A of the applicator tip 1. For instance, the applicator tip 1 comprises a ring wall 13 configured according to a cylindrical tube, preferably with a circular cross section, which is beveled on one of its ends according to the inclined plane P. The application surface 12 can also be somewhat convex and with a radius of curvature comprised between about 20 mm and 50 mm, for example about 25 mm or about 45 mm.

The acute angle of the bevel, i.e. the angle between the axis A and the inclined plane P, can be comprised between about 15° and about 70°, preferably between about 30° and 65°, more preferably about 45°.

The thickness of the metallic and/or organic filled plastic material under the application surface 12 is comprised between about 1.5 mm and about 5.5 mm, preferably between about 2 mm and about 5 mm. The thickness is to be measured perpendicularly to the application surface 12.

On the other end of the tube which is not beveled, the edges 14 of the ring wall 13 are tapered so as to make the introduction of the applicator tip 1 easier into a tube head through such other end.

A circumferential stop 15, being preferably circular, is provided around the ring wall 13 and extends from the latter. The applicator tip 1 can also presents a through orifice 16 opening into a reservoir of a cosmetic product tube. Thus, the cosmetic product can be directly distributed on the application surface 12 through the orifice 16.

The thickness of the ring wall 13 is comprised between about 1.5 mm and about 5.5 mm, preferably between about 2 mm and about 5 mm. When the cylindrical tube according which the ring wall 13 has a circular cross section, the external radius of such section is comprised between about 9 mm and about 10.5 mm, preferably between about 9.5 mm and about 10 mm, more preferably about 9.8 mm. The circumferential stop being also circular then presents an external radius comprised between 10 mm and about 13.5 mm, preferably between about 10.8 mm and about 12.7 mm.

Between the other end and the circumferential stop, the applicator tip can present a fastener for attaching it to a tube head. Such fastener can be made under the shape of a circumferential rib projecting from the ring wall. The circumferential rib can project by about 0.1 mm to about 0.5 mm from the ring wall 13. Such circular rib is engaged in the snapping of the applicator tip on a tube head. The fastener can also be made under the shape of a thread when the ring wall 13 is circular. Furthermore, the fastener is not useful when the applicator tip is forcibly attached to the tube head.

The applicator tip 1 can be used in a container for cosmetic products, such as an eye contour cream, a dark circle and/or under eye bag cream, an anti-wrinkle eye contour cream, an antioxidation-antiglycation wrinkle and freshness multicorrector care, a lip contour, a skin cream. The container for cosmetic products then comprises a reservoir to contain the cosmetic product and the applicator tip such as above described. Thus, the user can spread the cosmetic product thanks to the applicator tip which confers him then a freshness sensation thanks to the cold effect. Such cold effect can present various advantages according to the cosmetic product being applied for example a refreshing and/or calming effect.

EXAMPLE 1

The applicator tip of example 1 comprises a convex external application surface having in its largest part a radius of curvature of 25 mm. Such application surface extends according to an inclined plane with respect to the axis of the applicator tip. The thickness of the material under the application surface is about 2.2 mm. The applicator tip comprises a ring wall of a thickness of 2.2 mm and is configured according to a cylindrical tube with a circular cross section which is beveled with an acute angle of 42° on one of the ends thereof according to the inclined plane. The external radius of the circular cross section is 9.8 mm.

On the other non beveled end of the tube, the edges of the ring wall are tapered so as to present a thickness of 1 mm.

A circular circumferential stop is provided around the ring wall and extends from the latter. The external radius of the circular circumferential stop is 12.5 mm.

The applicator tip presents a through orifice with a radius of 2 mm and adapted to open into a reservoir of a cosmetic product tube.

EXAMPLE 2

The applicator tip of example 2 comprises a convex external application surface having in its largest part a radius of curvature of 45 mm. Such application surface extends according to an inclined plane with respect to the axis of the applicator tip. The thickness of the material under the application surface is about 4.7 mm. The applicator tip comprises a ring wall with a thickness of 4.7 mm and is configured according to a cylindrical tube with a circular cross section which is beveled with an acute angle of about 42° on one of its ends according to the inclined plane. The external radius of the circular cross section is 9.8 mm.

On the other non beveled end of the tube, the edges of the ring wall are tapered so as to present a thickness of 2 mm.

A circular circumferential stop is provided around the ring wall and extends from the latter. The external radius of the circular circumferential stop is 11 mm.

Between the other end and the circumferential stop, the applicator tip presents a circular rib projecting by 0.1 mm from the ring wall.

The applicator tip presents a through-orifice with a radius of 2 mm and is adapted to open into a reservoir of a cosmetic product tube.

EXAMPLE 3

Examples of metallic or organic filled plastic materials are given in the table 1 herein below.

TABLE 1

| | Plastic 1 | Plastic 2 | Plastic 3 | Plastic 4 |
|---|---|---|---|---|
| Base | PEEK | PPS | PPA | PA6 |
| Type of fillers | Organic: carbon and graphite fiber | Organic: carbon and graphite fiber | Organic: carbon and graphite fiber | Metallic: metal mineral salts |
| Quantity of fillers | 40 wt % | 40 wt % | 40 wt % | 45 wt % |
| Effusivity $J \cdot K^{-1} \cdot m^{-2} \cdot sec^{-1/2}$ | 7370 | 7130 | 5720 | 4010 |

TABLE 1-continued

| | Plastic 1 | Plastic 2 | Plastic 3 | Plastic 4 |
|---|---|---|---|---|
| Thermal conductivity W/(m · K) | 22 | 22 | 20 | 10 |
| Diffusivity $m^2$/sec | 8.9 | 9.5 | 12.2 | 6.2 |
| Volume weight g/$cm^3$ | 1.64 | 1.65 | 1.56 | 1.6 |

What is claimed is:

1. A cold effect applicator tip for cosmetic products, the applicator tip made of a plastic material comprising at least one of organic fillers, metallic fillers, and a mixture of organic fillers and metallic fillers, wherein the fillers represent at least about 20 wt % of the plastic material.

2. The applicator tip according to claim 1, wherein the organic materials include materials selected from the group of graphite, carbon fiber and a mixture of graphite and carbon fiber.

3. The applicator tip according to claim 1, wherein the plastic material comprises a plastic base selected from the group consisting of a polyetheretherketone, a phenylene polysulfide, a polyphthalamide, a polyamide, a polyimide, a polyoxymethylene, a polyimide-amide and an elastomer.

4. The applicator tip according to claim 1, wherein the plastic material presents an effusivity being higher than or equal to 4000 $J \cdot K^{-1} \cdot m^{-2} \cdot sec^{-1/2}$.

5. The applicator tip according to claim 1, wherein the plastic material presents an effusivity being higher than or equal to 4700 $J \cdot K^{-1} \cdot m^{-2} \cdot sec^{-1/2}$.

6. The applicator tip according to claim 1, wherein the plastic material presents an effusivity being higher than or equal to 7100 $J \cdot K^{-1} \cdot m^{-2} \cdot sec^{-1/2}$.

7. The applicator tip according to claim 1, wherein the plastic material presents an effusivity being higher than or equal to 7300 $J \cdot K^{-1} \cdot m^{-2} \cdot sec^{-1/2}$.

8. The applicator tip according to claim 1, wherein the plastic material presents a thermal conductivity being higher than or equal to 10 W/(m·K).

9. The applicator tip according to claim 1, further presenting a lacquered application surface.

10. The applicator tip according to claim 9, wherein the lacquered application surface is tinted.

11. The applicator tip according to claim 9, wherein the lacquered application surface metalized or galvanized.

12. The applicator tip according to claim 9, wherein the lacquered application surface is galvanized.

* * * * *